United States Patent [19]

Stewart

[11] 4,382,544

[45] May 10, 1983

[54] ENERGY MANAGEMENT SYSTEM WITH PROGRAMMABLE THERMOSTAT

[75] Inventor: John T. Stewart, Basking Ridge, N.J.

[73] Assignee: J. T. Stewart Associates, Inc., Basking Ridge, N.J.

[21] Appl. No.: 176,572

[22] Filed: Aug. 8, 1980

[51] Int. Cl.[3] ..... F23N 5/20; G05D 23/00

[52] U.S. Cl. ..... 236/46 R; 165/12; 236/51; 340/825.52

[58] Field of Search ..... 340/147 R, 147 P, 309.1; 165/22, 12, 26; 236/46 R, 51; 307/39, 41; 364/104, 505, 506, 557

[56] References Cited

U.S. PATENT DOCUMENTS

| | | | |
|---|---|---|---|
| 4,079,366 | 3/1978 | Wong | 340/309.4 |
| 4,083,397 | 4/1978 | Kimpel et al. | 165/26 |
| 4,132,355 | 1/1979 | Cleary et al. | 236/47 |
| 4,217,646 | 8/1980 | Caltagirone et al. | 165/22 X |
| 4,235,368 | 11/1980 | Neel | 236/94 |

*Primary Examiner*—William E. Wayner
*Attorney, Agent, or Firm*—Richard C. Conover

[57] ABSTRACT

An electronic system and method including a user programmable thermostat for measuring temperature at the situs of the measurement unit and for signaling and controlling a remotely located energy controller which is connected to the programmable thermostat. By utilizing a multiplexed signal communication channel between the programmable thermostat and the energy controller, the energy controller activates preselected energy using units which may, for example, include a furnace and air conditioning units for controlling the temperature at the measurement unit situs and a power shedder unit for shedding energy usage to conserve energy all in accordance with a user provided program.

7 Claims, 6 Drawing Figures

ENERGY MANAGEMENT SYSTEM WITH PROGRAMMABLE THERMOSTAT

BACKGROUND OF THE INVENTION

This invention relates to a programmable thermostatic control and energy management system which is constructed, for example, to replace conventional thermostatic controls in a residence and is used to control the temperature at the measurement situs in accordance with the programmed requirements of the user and also to shed energy usage in accordance with the programmed requirements of the user to lower energy usage.

Conventional thermostats located in rooms where the temperature is to be controlled are commonly connected via two leads (heating) or four leads (heating and cooling) to a furnace and/or an air conditioner. These thermostats have dials or other means for setting the desired temperature level and in addition have switches for switching to a heating mode or a cooling mode. When the actual room temperature falls below the minimum temperature setting and the thermostat operating in a heating mode, a heating unit is activated and when the actual room temperature rises above a maximum temperature and the thermostat operating in a cooling mode, the cooling unit is activated. Such conventional thermostats may be of the analog type which employ a mercury thermostat or a bi-metallic strip to measure and display the temperature or may be of the digital-type which employ a digital temperature transducer to display the temperature in a digital format and control the temperature through digital circuitry. These systems, conventionally, are for temperature control only and do not have energy management capabilities.

A programmable thermostatic control is described in U.S. Pat. No. 4,071,745. This control is connected to a temperature sensor located at the place the temperature is to be controlled. A user may program the programmable control unit to activate heating or cooling systems to provide thermostatic control at the sensor location according to the user programmed temperature settings. With this programmable control, a user has the capability to program different temperature levels for different times of the day such as hour by hour.

Another programmable thermostatic control is described in U.S. Pat. No. 3,964,677. This control includes digital counting circuitry for controlling the temperature of an area for at least two different selected temperatures at selected times and for selected periods. This control can be used to replace conventional thermostats and installed without modifying existing wiring. Furthermore, the control is operated from the electrical power supplied from a conventional furnace power supply.

U.S. Pat. No. 4,079,366 describes an electronic programmable clock timer which can be used to control heating and cooling for selected periods of time and for controlling other electrical functions such as lights for selected periods of time.

Honeywell, Inc. is presently marketing a Microelectronic Fuel Saver Thermostat under the tradename Honeywell T800. This unit is described in the copyrighted Honeywell, Inc. publication No. 50-6681. This device is a programmable thermostatic control installed at the location where the temperature is to be controlled and utilizes existing thermostat wires to control the heating and cooling systems. With this device, the thermostat may be programmed for once-a-day or twice-a-day setback/set up and may be set to automatically skip the daytime program on two days such as weekends to further conserve energy.

Power management systems are also known such as the IBM Facility Control/Power Management System described in IBM Booklet No. GH30-0094-0. This System, which because of its size and complexity is generally used in large commercial or industrial applications, utilizes an IBM Series/I Computer to conserve energy by lowering power loads and reducing demand peaks. With this System, energy using units such as heaters, fans, pumps may be shut completely off to reduce energy usage when certain programmed threshhold levels are reached or the system may be used to shed energy through staging. All of this may be accomplished within selected control periods during the day which may range from minutes to hours during any 24-hour day.

SUMMARY OF THE INVENTION

The present invention is an improvement over conventional programmable thermostat controls and energy management systems in that the present invention provides a versatile, compact control system which combines thermostat control with energy management and has particular application in residences although it could be used equally well in industrial locations. The present invention is constructed to permit simple replacement of conventional in situ thermostats. No additional wiring is necessary from the thermostat location, wherein, in many instances, the wiring is located within a wall and access to the wiring is difficult.

This improved programmable thermostat includes two physically separated units. The first unit, being a programmable thermostat, is situated at the location where temperature is to be controlled. This is connected preferably with conventional and existing four-wire thermostat wires to a second unit, the energy controller, located remotely from the programmable thermostat. In a residence, this energy controller could be located in the basement where additional local wiring can be installed easily. The energy controller is connected to the energy using units to be controlled, for example, the water heater, the air conditioner, the furnace, and other energy users. In addition, the energy controller is connected to an energy shedder to shed consumption of energy when programmed to do so.

The programmable thermostat may be programmed by a user to control temperature at the thermostat location for preselected times of day and days of week. As an example, lower temperature at night (called set back) and higher temperature during day (called set up) for Monday through Friday but lower temperature (set back) all day and all night during Saturday and Sunday. In addition, the thermostat can be programmed to conserve energy and lower utility bills by shedding energy loads during preselected periods utilizing conventional shedding apparatus.

The programmable thermostat and the energy controller are connected together in a preferred embodiment by conventional four-wire thermostat wires. With the present invention, these wires are used to direct low voltage electrical power to the programmable thermostat and for a low voltage, low speed data channel between the thermostat and the controller. Multiplexing is used so that more than one signal may be transmitted on one pair of the two-wire pairs to control the energy using units connected to the controller.

BRIEF DESCRIPTION OF THE DRAWINGS

In order that the invention may be clearly understood and readily carried into effect, a preferred embodiment will now be described, by way of example only, with reference to the accompanying drawings wherein.

DESCRIPTION OF A PREFERRED EMBODIMENT

Figure 1:
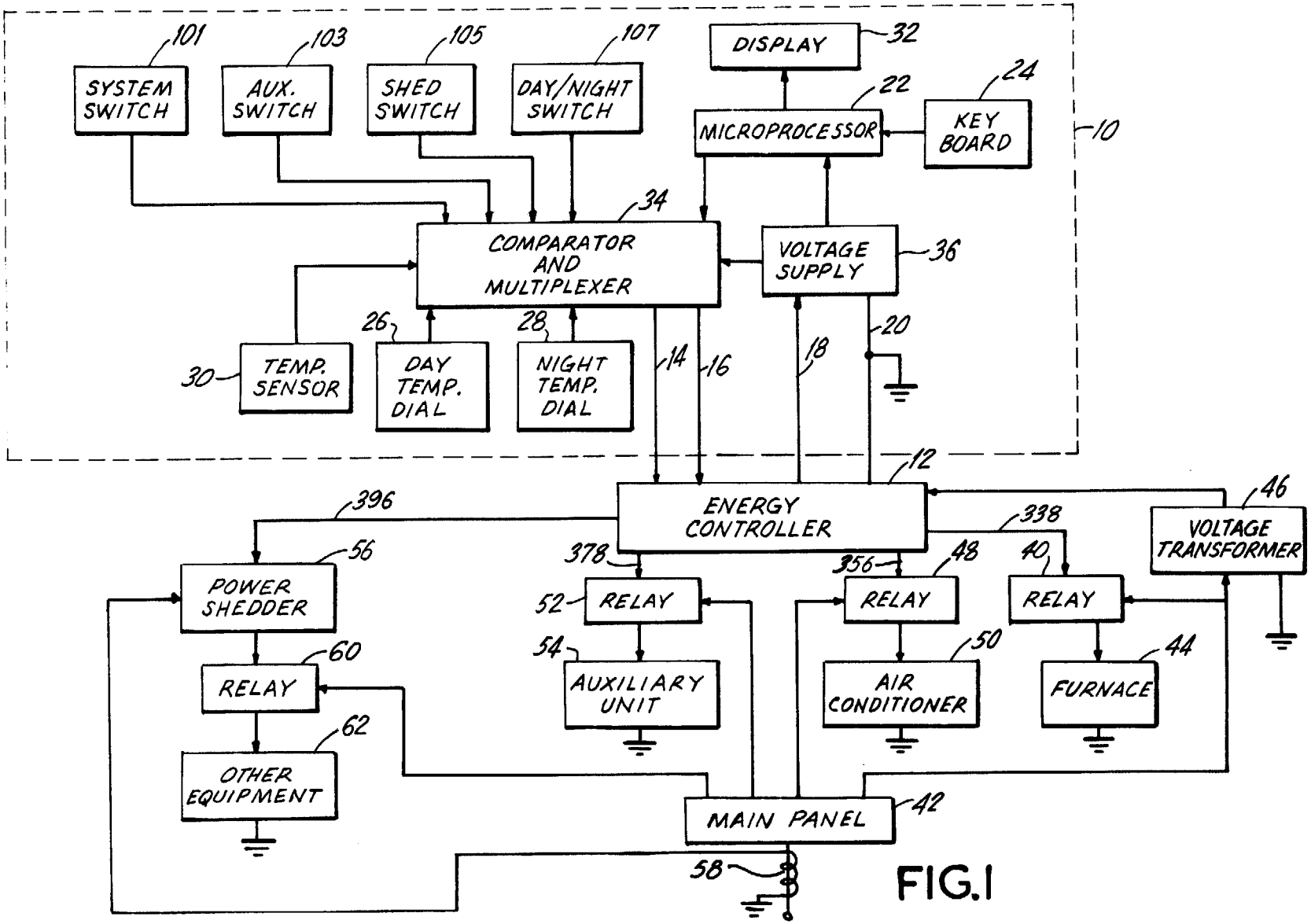
FIG. 1 is a schematic block diagram of the entire system including the programmable thermostat and the energy controller according to the principles of this invention.

A programmable thermostat and energy management system is shown schematically in FIG. 1 and includes a programmable thermostat 10 and a remotely located energy controller 12 connected in a preferred embodiment via four leads 14, 16, 18 and 20. Although four leads are shown connecting the programmable thermostat and the energy controller 12, the number of leads is not critical to the practice of the invention as multiplexing is used to reduce the number of leads required to control various energy using items of equipment. In a preferred embodiment, however, and as shown in FIG. 1, four leads are used. Lead 20 is a reference voltage or ground lead; lead 18 carries low voltage alternating current ($V_{AC}$) obtained from a conventional furnace power supply as will be described; and leads 14 and 16 carry multiplexed control signals to control the energy controller 12. These leads may comprise the existing four-wire heating/air conditioning leads conventionally existing in residences today.

The programmable thermostat 10 includes a microprocessor 22 to which is connected an input keyboard 24 and an output display unit 32 as shown in FIG. 1. The microprocessor 22 is connected to a comparator and multiplexer circuit 34 to which is connected an input day temperature setting dial 26, an input night temperature setting dial 28 and an input temperature sensor 30. The comparator and multiplexer circuit 34 provides multiplexed signals to the energy controller 12 via leads 14 and 16 to actuate selected energy using units in accordance with the program stored in the microprocessor 22. A voltage supply 36 is connected to leads 18 and 20 connected to energy controller 12 and provides necessary voltage levels to enable the microprocessor 22 and the comparator and multiplexer circuit 34 to operate properly.

Figure 2:
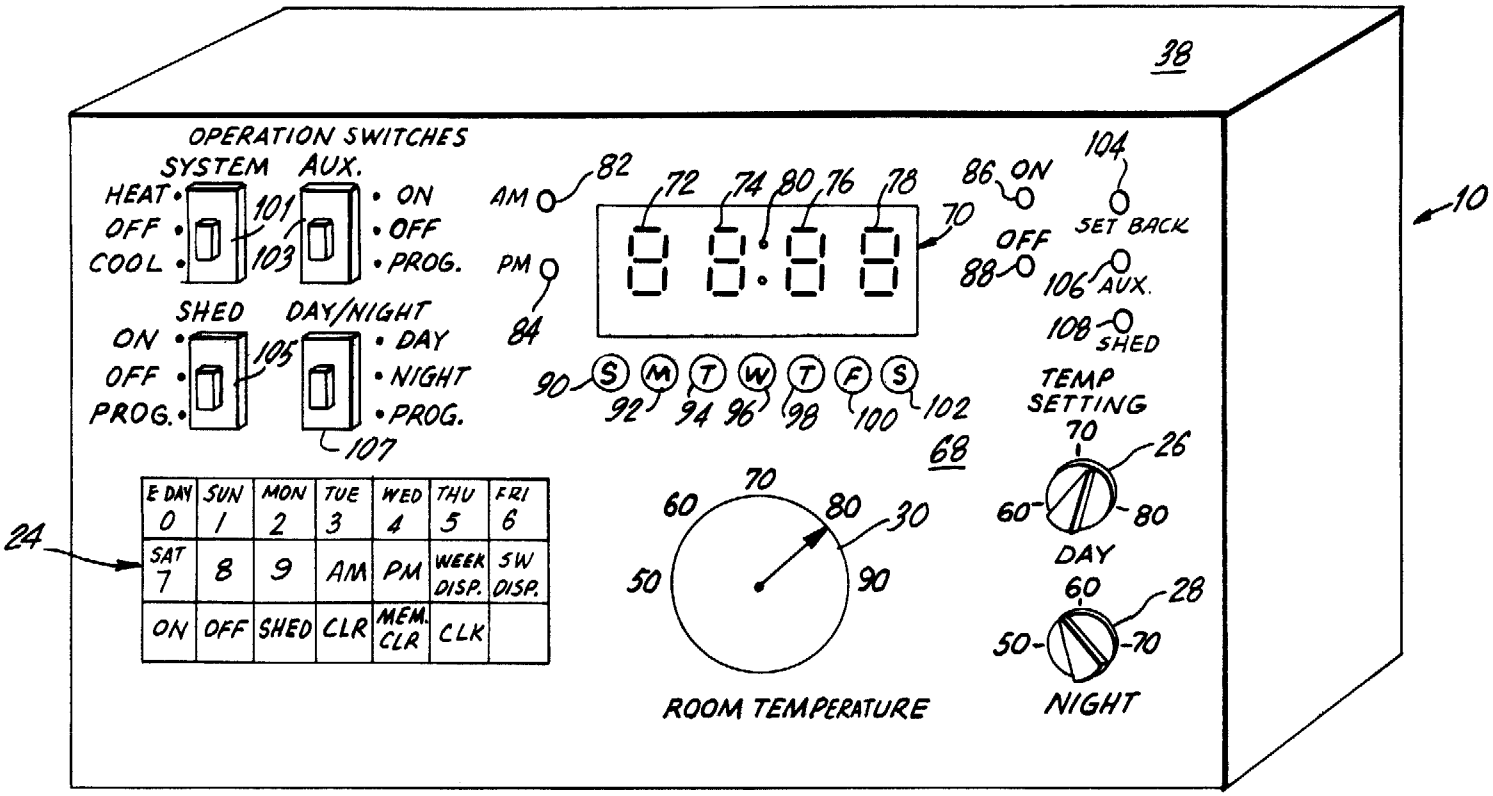
FIG. 2 is a perspective front view of the programmable thermostat.

The programmable thermostat 10 is enclosed in a housing 38 as shown in FIG. 2. This housing 38 is located in the area where the temperature is to be controlled and where the user has easy access for programming the programmable thermostat 10, which may be, for example, a living room in a home residence. If a four-wire thermostat is already in place, the programmable thermostat 10 may be used to replace the existing thermostat. The energy controller 12 is remotely located from the programmable thermostat 10. In a residence, for example, the energy controller 12 may be located in the basement where it is easily accessible. The energy using units to be controlled may then be connected to the energy controller 12. If new wiring is necessary, this is generally an easy matter since wiring in basement areas is normally exposed.

The energy controller 12 is electrically connected to a furnace control relay 40. Electrical power from a service entrance (not shown) is directed through a main panel 42 to the relay 40. The relay 40 directs electrical power to a furnace 44 when the relay 40 is actuated by a signal from the energy controller 12. A voltage transformer 46 provides low voltage alternating current for energizing the energy controller and the programmable thermostat 10. Line voltage from the main panel 42 is applied to the voltage transformer 46 which is connected to the energy controller 12. In a residence, the voltage transformer 46 is conventionally included with the furnace power supply.

In the embodiment shown in FIG. 1, the energy controller 12 is also connected to an air conditioner control relay 48 for controlling the energization of an air conditioner unit 50. The relay 48 is connected to the main panel 42 in a conventional manner. Likewise, the energy controller 12 is connected to an auxiliary energy using unit 54 and the main panel 42. When the relay 52 is activated by energy controller 12, the auxiliary unit is connected to line voltage.

The energy controller in a preferred embodiment, is also connected to a conventional power shedder 56 such as a Square D Class 8865 Type EM-8 manufactured by the Square D Company. A conventional current transformer 58 such as manufactured by the Square D Company is positioned around the incoming service line as shown in FIG. 1 and is connected to the power shedder 56. The current transformer 58 measures the total amount of current usage of the system. The power shedder 56 is connected to relay 60 for controlling energy using equipment 62. This equipment may be lights, motors or other equipment. The relay 60 is connected to the main panel 42 in a conventional manner.

The power shedder 56 is actuated when it receives a command signal from the energy controller 12. When the command signal is received, the power shedder 56 monitors the signal from the current transformer 58 and compares it with an adjustable demand target signal. Whenever demand exceeds target, shedding action is commenced by opening the relay 60 for preselected periods of time until the demand is lowered below target. It is understood that multiple items of energy using equipment may be connected to the power shedder 56 and power may be shed from all or some of these items all of which is within the state of the art. It is also contemplated that power shedder 56 can monitor natural gas usage if this form of energy is used and shed power delivered to units using such gas.

With the present system, a user may enter through the keyboard 24 of programmable thermostat 10 the times during the day and days of the week the temperature should be maintained at the night temperature setting of dial 28 (set back). As will be described in greater detail below, the microprocessor 22 will then automatically activate the comparator and multiplexer circuit 34 to signal the energy controller 12 to energize either the furnace 44 or the air conditioner 50 whichever mode of operation has been selected. At all other times, the temperature will be maintained above or below the day temperature setting of dial 26 (set up) under control of microprocessor 22 depending on whether the heating or cooling mode of operation is selected.

Similarly, the user may enter times of day and days of week information through the keyboard 24 during which the auxiliary unit 54 is to be deactivated. For example, the auxiliary unit may be a water heater having its own thermostat to regulate water temperature. The programmable thermostat 10 enables a user to deactivate the water heater during selected times of the day to conserve energy. Furthermore, the programmable thermostat 10 may be used to control the power shedder 56 to further conserve energy. With this apparatus, a versatile and compact energy management system is provided.

Figure 3:
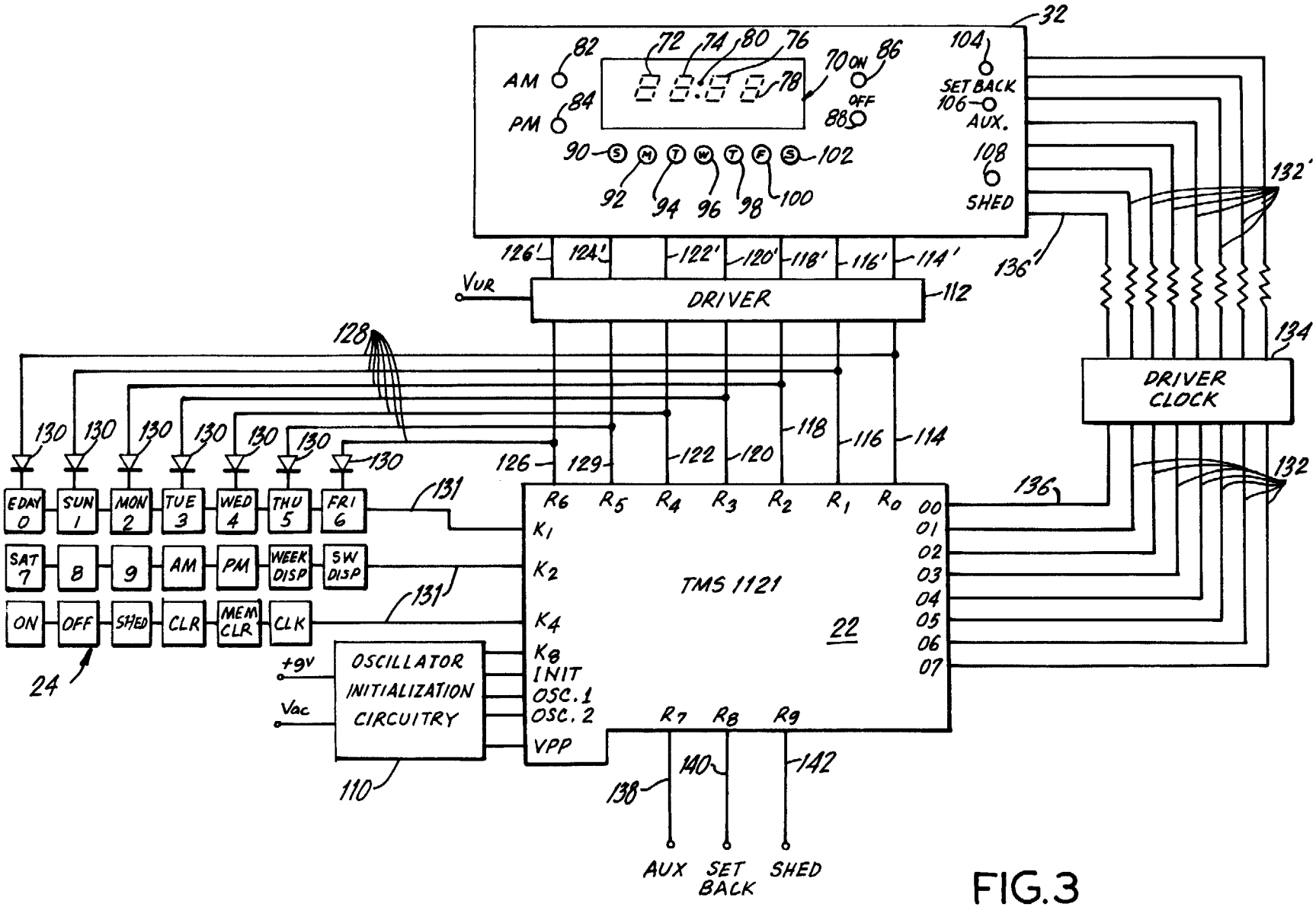
FIG. 3 is a schematic block diagram of the microprocessor, keyboard and display of the programmable thermostat.
Figure 4:
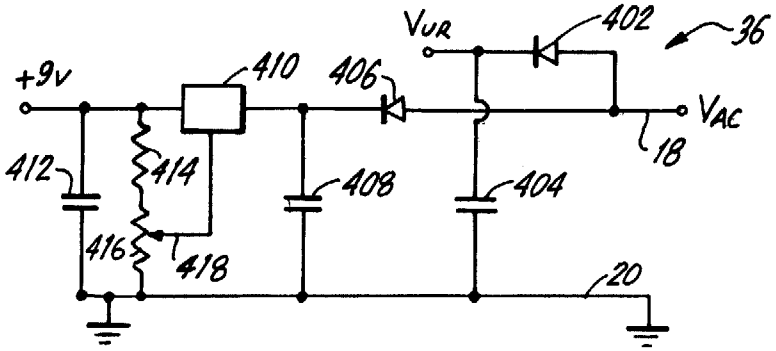
FIG. 4 is a schematic diagram of the voltage supply for the programmable thermostat.

Details of the programmable thermostat 10 are shown in FIGS. 2, 3 and 4. The housing 38 of programmable thermostat 10 is shown in FIG. 2. The housing 38 includes a face plate 68 on which is mounted the manually settable day temperature dial 26 and the manually settable night temperature dial 28. The temperature sensor 30 is also mounted on face plate 68 and includes visual display apparatus for display of the temperature at the situs of the programmable thermostat 10. The keyboard 24 is mounted on face plate 68 to permit the user to program the thermostat 10. A conventional four-digit multiplexed display 70 is located on the face plate 68. This display 70 utilizes LEDs or other similar display devices for displaying seven segment characters. As shown in FIG. 2, the display 70 includes four seven-segment displays including display 72 to show 10's of hours, display 74 to show unit hours, display 76 to show 10's of minutes and display 78 to show unit minutes. A colon display 80 displays a colon to separate the hours from the minutes. The display unit 70 may also be used to display program information as when a user programs the thermostat 10.

LEDs 82 and 84 mounted on face plate 68 display "AM" and "PM" respectively. LEDs 86 and 88 display program information during programming of the programmable thermostat 10. LEDs 90, 92, 94, 96, 98, 100 and 102 indicate the day of week, i.e. Sunday through Saturday, respectively. LED 104 indicates whether programmable thermostat 10 is operating in the "SET BACK" mode, that is, in the night time temperature mode. LED 106 indicates whether the programmable thermostat 10 is deactivating "AUX", that is, the auxiliary unit 54 shown in FIG. 1. LED 108 indicates whether the programmable thermostat 10 is operating in the "SHED" mode thereby deactivating power shedder 56 as shown in FIG. 1. LEDs 104, 106 and 108 are also used during the programming of programmable thermostat 10 to display program information.

In addition, operation switches are mounted on faceplate 68 including a three-position "SYSTEM" switch manually settable to a "HEAT", "COOL" or "OFF" position to control whether the furnace should be activated, the air conditioning unit should be activated or neither should be activated by the programmable thermostat 10 respectively. Another operation switch, namely, a three-position "AUX" switch 103 is mounted on faceplate 68 and is manually settable to a "ON", "OFF" or "PROG" position. At the "ON" position, auxiliary unit 54 shown in FIG. 1 is energized; at the "OFF" position, auxiliary unit 54 is deactivated; and at the "PROG" position, energization of auxiliary unit 54 is controlled by programmed microprocessor 22 which deactivates auxiliary unit 54 at selected times of the day. Another three-position operation switch, a "SHED" switch 105, is mounted on face plate 68. This switch 105 is manually movable between an "ON", "OFF" and "PROG" position. The power shedder 56 shown in FIG. 1 is manually activated or deactivated when the switch 105 is moved to the "ON" or "OFF" position respectively. When switch 105 is at the "PROG" position, deactivation of the power shedder 56 is controlled by programmed microprocessor 22. Another three-position operation switch, a "DAY/NIGHT" switch 107, is mounted on faceplate 68. This switch 107 is manually movable between "DAY", "NIGHT" and "PROG" positions. When the switch 107 is at the "DAY" or "NIGHT" positions, the programmed microprocessor 22 will maintain the temperature at the programmable thermostat 10 situs at the temperature set with day temperature dial 26 or the night temperature dial 28 respectively. With the switch 107 set at the "PROG" position, the programmed microprocessor 22 will control the times when the temperature will be maintained at the "DAY" temperature and when the temperature will be maintained at the "NIGHT" temperature.

Details of the microprocessor 22, the keyboard 24 and display 32 of the programmable thermostat 10 are shown in FIG. 3. The keyboard 24 and display LEDs are also shown on the faceplate 68 as shown in FIG. 2. Referring to FIG. 3, the microprocessor 22 in this preferred embodiment comprises a "TMS 1121 Universal Timer Controller" manufactured by Texas Instruments Incorporated. This is TMS 1121 is described in a "Universal Timer Controller Manual" distributed by Texas Instruments Incorporated and this Manual is hereby incorporated by reference. FIG. 1 set forth in this Manual is identical with FIG. 3 set forth herein with the exception that the display portion shown in FIG. 3 has been modified to show the specific application of the present invention. In addition, oscillator initialization circuitry 110 shown in FIG. 3 is substituted for corresponding circuitry shown in FIG. 1 of the TMS 1121 Manual. The oscillator initialization circuitry 110 utilized with the present invention corresponds with the initialization circuitry shown in FIG. 4 of the TMS 1121 Manual. Leads 114, 116, 118, 120, 122, 124 and 126 are connected to terminals $R_0$, $R_1$, $R_2$, $R_3$, $R_4$, $R_5$ and $R_6$ respectively of microprocessor 22 and connect microprocessor 22 to display driver 112. The display driver 112 is connected to a conventional multiplexed display unit 32 with corresponding leads 114', 116', 118', 120', 122', 124' and 126'. Leads 114, 114' carry a multiplexed signal for lighting the appropriate "AM" or "PM" LEDs 82 and 84 and the appropriate "ON" or "OFF" LEDs 86 and 88. Leads 116, 116' carry a signal for lighting the unit minute digit 78 of display 70; leads 118, 118' carry a signal for activating 10's of minutes digit 76; leads 120, 120' carry a signal for activating unit hours digit 74 and leads 122, 122' carry a signal for activating 10's of hours digit 72. Leads 124, 124' carry a multiplexed signal for lighting one of the appropriate LEDs 90, 92, 94, 96, 98, 100 or 102 corresponding to the day of week. Leads 126, 126' carry a multiplexed signal for lighting the appropriate LEDS 104, 106 and 108 to indicate whether the system is operating in the "SET BACK", "AUX" or "SHED" mode of operation.

A voltage $V_{UR}$ is applied to driver 112 to provide a power supply for the LEDs in display unit 32. This voltage is derived from voltage supply 36 shown in FIGS. 1 and 4 and will be described below.

The keyboard 24 as shown in FIG. 2 and FIG. 3 is also shown and described in the "Universal Timer Controller Manual" identified above. This keyboard 24 is a matrix keyboard having seven columns and three rows. Leads 128, connected to the column leads of the matrix keyboard 24, are connected via diodes 130 to the leads connecting the microprocessor 22 and driver 112 as shown in FIG. 3. These diodes 130 function as conventional coupling diodes. Leads 131, connected to the row leads of the matrix keyboard 24, are connected to terminals $K_1$, $K_2$ and $K_4$ of microprocessor 22 as shown in FIG. 3 and also FIG. 4 of the TMS 1121 Universal Timer Controller Manual.

To energize the appropriate segments of seven-segment digit displays 72, 74, 76 and 78 of the display 70, the microprocessor 22 transmits signals via leads 132 to driver 134 and then to the display 70 via leads 132'. Since the digit displays 72, 74, 76 and 78 are each seven-segment displays, there are seven leads connected to terminals 01, 02, 03, 04 and 06 of microprocessor 22. Each lead 132 is connected to one of the segments of each of the seven-segment displays. Lead 136 connects terminal 00 of microprocessor 22 to driver 134 and lead 136' connects driver 134 to display 70. These leads 136 and 136' carry a signal to activate the colon display 80. Microprocessor 22 acting under its masked program as described in the "Universal Timer Controller Manual" displays appropriate information, such as the time of day, on display 70 via leads 116, 118, 120, 122 and leads 132 and lead 136.

The oscillator initialization circuitry 110 is connected to terminals $K_8$, Init., OSC 1, OSC 2 and $V_{PP}$ of microprocessor 22 as shown in FIG. 4 of the "Universal Timer Controller Manual". This circuitry 110 initializes the various timing circuits within the microprocessor 22 upon startup so that it operates properly. Two voltages, namely a +9 V and $V_{AC}$ are applied to the circuitry 110 from voltage supply 36 described below.

Control signals are supplied by microprocessor 22 to terminals $R_7$, $R_8$ and $R_9$ of microprocessor 22. An AUX control signal is supplied to lead 138 from terminal $R_7$; a "SET BACK" signal is supplied to lead 140 from terminal $R_8$ and a "SHED" signal is supplied to lead 142 from terminal $R_9$. These signals are directed to the comparator and multiplexer circuit 34 via leads 138, 140 and 142 respectively as shown in FIGS. 3 and 5.

The voltage supply 36 for supplying voltages to the programmable thermostat 10 is shown in FIG. 4. Positive half cycles of voltage $V_{AC}$ from lead 18 is transmitted through diode 402. The voltage $V_{UR}$ appears at the negative side of diode 402. Filtering capacitor 404 connects the negative side of diode 402 to the ground lead 20. Positive half cycles of $V_{AC}$ on lead 18 are directed through diode 406, the negative side of which diode is connected to ground through capacitor 408. These positive half cycles are transmitted to voltage regulator 410, the output of which is the voltage +9 V used by the microprocessor 22. The output terminal of voltage regulator 410 is connected to ground through filtering capacitor 412. A voltage adjustment circuit, including serially connected resistor 414 and variable resistor 416, connects the output terminal of voltage regulator 410 to ground. A wiper arm 418 connected to variable resistor 416 is connected to voltage regulator 410 to adjust the +9 V to the proper voltage.

Figure 5:
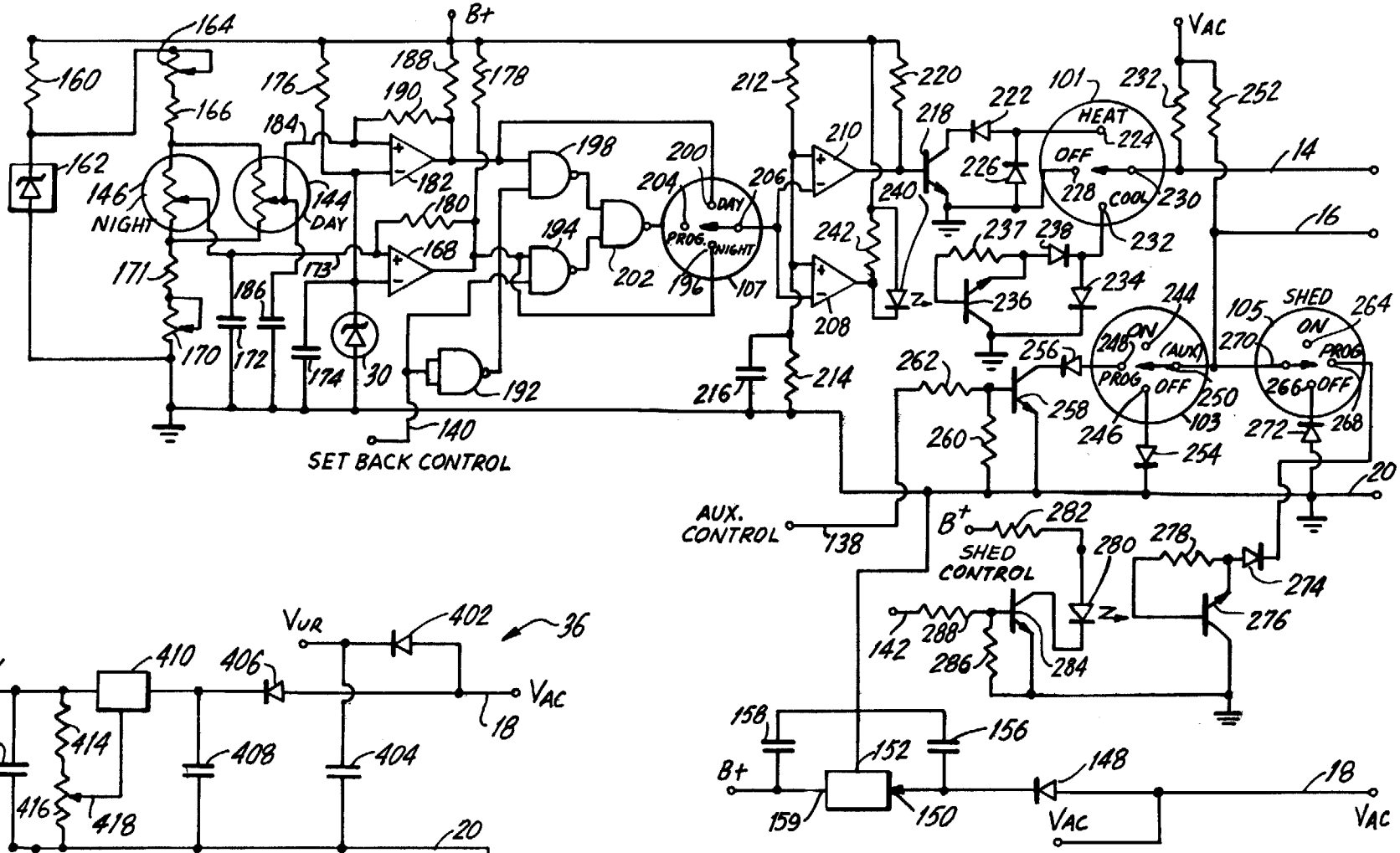
FIG. 5 is a schematic diagram of the comparator and multiplexer circuitry of the programmable thermostat.

The details of the comparator and multiplexer circuit 34 are shown in FIG. 5. The day temperature dial 26 is mechanically connected to variable resistor 144 and the night temperature dial 28 is connected to variable resistor 146. The operation switches—SYSTEM switch 101, AUX switch 103, SHED switch 105 and DAY/-NIGHT switch 107—are all connected to the comparator and multiplexer circuit 34 as shown in FIG. 5. The temperature sensor 30 may be a conventional integrated circuit as manufactured by National Semiconductor. The voltage output of the temperature sensor 30 is a function of the temperature and this signal is used by the comparator and multiplexer circuit 34 to determine whether the heating or cooling units should be activated. Furthermore, this signal is displayed as shown in FIG. 2 to provide a visual indication of the temperature at the situs of the programmable thermostat 10.

The low voltage alternating current power signal $V_{AC}$ is directed to the comparator and multiplexer circuit 34 from energy controller 12 via lead 18 and the reference voltage or ground is connected to the comparator and multiplexer circuit 34 with lead 20. The voltage $V_{AC}$ on lead 18 is directed through a rectifier diode 148 and then to the input terminal 150 of a conventional voltage regulator 152 which at its output terminal 154 provides a B+ voltage utilized as a supply voltage as shown in FIG. 5. The voltage regulator 152 is connected to ground. The input terminal 150 is also connected to ground through filtering capacitor 156, and the output terminal 154 is connected to ground through filtering capacitor 158.

The B+ voltage is applied to a bias resistor 160 and then through integrated circuit 162 to ground. The integrated circuit 162 is a conventional circuit which corrects for variations of the B+ voltage which may occur with temperature variations and which result from manufacturing tolerances of voltage regulator 152.

Variable resistor 164, resistor 166, variable resistor 146, resistor 171 and variable resistor 170 are serially connected. This series of resistors is connected in parallel to integrated circuit 162. The variable resistors 164 and 170 are "factory adjustable" resistors for calibrating the circuit with respect to manufacturing variations of the integrated circuit 162 and the temperature sensor 30.

The wiper of variable resistor 146, adjustable with the night temperature dial 28, is connected to the positive input terminal of a conventional comparator amplifier 168 via lead 173. Lead 173 is also connected to ground through capacitor 172. The capacitor 172 acts to filter out undesirable noise on lead 173. The negative input terminal of comparator amplifier 168 is connected to the output terminal of the temperature sensor 30. The other side of temperature sensor 30 is connected to ground. The negative input terminal of comparator amplifier 168 is also connected to ground through noise filtering capacitor 174. The negative terminal of amplifier 168 is further connected to the B+ voltage source through biasing resistor 176. The comparator amplifier 168 conventionally compares the voltage present at the positive input terminal with the voltage present at the negative input terminal. If the positive terminal has a higher voltage than the negative terminal, the output of the amplifier 168 goes "high". If the positive terminal voltage is lower than the negative terminal voltage, the output of amplifier 168 goes "low".

The amplifier 168 provides a "high" signal when the room temperature sensed by temperature sensor 30 is lower than the "NIGHT" temperature setting of night temperature dial 28 connected to thermostat 146.

The output terminal of comparator amplifier 168 is connected to the B+ voltage through bias resistor 178. Furthermore, the output terminal and the positive input terminal of comparator amplifier 168 are connected through through resistor 180. This resistor 180 provides a hysterisis function for the thermostatic control to prevent the system from "hunting" about the selected NIGHT temperature setting. Thus, with this invention, the furnace or air conditioner is not energized until the room temperature differs from the NIGHT setting by a preselected amount.

Regarding the DAY temperature control, the day variable resistor 144 is connected in parallel with the night variable resistor 146 and the wiper of variable resistor 144 is connected to the positive input terminal of comparator amplifier 182 via lead 184. Lead 184 is also connected to ground through capacitor 186 acting as a noise filter. The negative input terminal of amplifier 182 is connected to negative input terminal of amplifier 168 so that the same signal from temperature sensor 30 is applied to both negative input terminals. The amplifier 182 functions with respect to the DAY signal in same manner as amplifier 168 functions with respect to NIGHT signal. Thus, when the day temperature setting of variable resistor 144 is higher than the temperature sensed by temperature sensor 30, the output of amplifier 182 will go "high". The output terminal of amplifier 182 is connected to the B+ voltage through resistor 188 and is connected to the positive input terminal of amplifier 182 through hysterisis resistor 190.

The "SET BACK" control signal from microprocessor 22 shown in FIG. 3 is connected to both input terminals of NAND gate 192 via lead 140. NAND gate 192 acts as an invertor; thus when the "SET BACK" signal is "high", the output of gate 192 is "low" and visa versa. The "SET BACK" signal on lead 140 is also applied to an input terminal of NAND gate 194. The output of amplifier 168 is applied to the other input terminal of NAND gate 194 and to the "NIGHT" terminal 196 of DAY/NIGHT switch 107.

The output of invertor NAND gate 192 is applied to an input terminal of NAND gate 198. The output of amplifier 182 is applied to the other input terminal of NAND gate 198 and also to the "DAY" terminal 200 of DAY/NIGHT switch 107.

The output of NAND gate 194 is applied to an input terminal of NAND gate 202 and the output of NAND gate 198 is applied to the other input terminal of NAND gate 202. The output of NAND gate 202 is connected to PROG terminal 204 of DAY/NIGHT switch 107.

With the switch arm 206 of DAY/NIGHT switch 107 set to DAY terminal 200, a signal will appear on a switch arm 206 only when the actual temperature voltage from temperature sensor 30 is lower than the "DAY" reference voltage from the wiper of variable resistor 144. With the switch arm 206 of DAY/NIGHT switch 107 set to NIGHT terminal 196, a signal will appear on switch arm 206 only when the actual temperature voltage from temperature sensor 30 is lower than the "NIGHT" reference voltage from the wiper of variable resistor 146. Furthermore, the logic circuitry of the NAND gates 192, 194, 198 and 202 is such that when the switch arm 206 of DAY/NIGHT switch 107 is set to PROG terminal 204, a signal will appear on switch arm 206 only when the signal on "SET BACK" lead 140 is low or off and the actual temperature voltage from temperature sensor 30 is lower than the "DAY" reference voltage from the wiper of viarable resistor 144 or when the signal on "SET BACK" lead 140 is high or on and the actual temperature voltage from temperature sensor 30 is lower than the "NIGHT" reference voltage from the wiper of variable resistor 146.

The switch arm 206 of switch 107 is connected to each of the negative input terminals of comparator amplifiers 208 and 210. Each of the positive input terminals of amplifiers 208 and 210 are connected to the B+ voltage through bias resistor 212 and to ground through a noise filter capacitor 216 connected in parallel with resistor 214.

The output terminal of amplifier 210 is applied to the base of switching transistor 218. A bias resistor 220 is connected between the base of transistor 218 and the B+ voltage. The collector of transistor 218 is connected through diode 222 to "HEAT" terminal 224 of SYSTEM switch 101. The diode 222 is oriented to transmit positive signals from the HEAT terminal 224 to the collector of transistor 218. Another diode 226 is connected between HEAT terminal 224 and ground and is oriented to transmit negative signals at the HEAT terminal 224 to ground. The switch 101 further includes an "OFF" terminal 228 connected directly to ground and a switch arm 230 connected to lead 14 for transmitting control signals to the energy controller 12 as shown in FIG. 1. The voltage $V_{AC}$ from lead 18 is directed to switch arm 230 through resistor 232.

When the switch arm 230 of SYSTEM switch 101 is moved to the "OFF" position 228, the voltage $V_{AC}$ appearing at the switch arm 230 is directed to ground and no signal is transmitted to energy controller 12 via lead 14.

When the switch arm 230 is moved to the "HEAT" position 224, the negative half cycles of voltage $V_{AC}$ at the switch arm 230 are transmitted to ground through diode 226. If the transistor 218 is conducting, the positive half cycles of voltage $V_{AC}$ at the switch arm 230 are also transmitted to ground through diode 222 and transistor 218. If the transistor 218 is not conducting, the positive half cycles of voltage $V_{AC}$ at the switch arm 230 are transmitted via lead 14 to the energy controller 12 to signal that the furnace should be turned on as will be described later. In a normal state, amplifier 210 has a "high" signal at its output terminal because the positive terminal has a higher positive voltage than the negative terminal since the positive terminal is connected to voltage B+ and the negative terminal to switch arm 206 of switch 107. However, when the comparator amplifiers 168 and 182 and the SET BACK logic circuitry (if DAY/NIGHT switch 107 set to PROG mode 204) determines that the actual temperature is lower than the reference temperature at this particular time and that the furnace should be turned on, a high signal will appear on switch arm 206 of DAY/NIGHT switch 107 and the output of amplifier 210 changes to low because the signal from switch arm 206 is more positive than voltage on positive terminal of amplifier 210. This will turn the transistor 218 into a nonconducting state whereby the positive half cycles of $V_{AC}$ will be transmitted via lead 14 to the energy controller 12 signaling the energy controller 12 to turn the furnace on.

The SYSTEM switch 101 further includes a "COOL" terminal 232. When the switch arm 230 of SYSTEM switch 101 is moved to the "COOL" position 232, the positive half cycles voltage $V_{AC}$ appearing at the switch arm 230 are transmitted to ground via diode 234. The negative half cycles are transmitted to ground via diode 238 and an opto-isolator transistor 236 only when transistor 236 is conducting. A bias resistor 237 connects the emitter and base of transistor 236. If transistor 236 is not conducting, negative half cycles appearing on switch arm 230 are transmitted via lead 14 to the energy controller 12 to signal that the air conditioner should be turned on as will be described later.

In a normal state opto-isolator transistor 236 is not conducting and the negative half cycles are being transmitted via lead 14 to energy controller 12. This is because in its normal state the comparator amplifier 208 has a high output. The voltage output of amplifier 208 opposes the voltage across resistor 242 which connects the output of amplifier 208 to the B+ voltage. With this arrangement, and with the voltage output of amplifier 208 at a high, the voltage across resistor 242 is insufficient to light a LED type diode 240 connected in parallel to resistor 242. The diode 240 is optically connected with opto-isolator transistor 236 and when diode 240 is not emitting light, transistor 236 is turned off. As described above with respect to amplifier 210, the comparator amplifier 208 normally has a "high" signal at its output terminal, because the positive terminal connected through resistor 212 to the B+ voltage normally has a higher voltage than the negative terminal connected to switch arm 206 of DAY/NIGHT switch 107. However, when the comparator amplifier 168 and 182 and the "SET BACK" logic circuitry (if DAY/-NIGHT switch 107 set to PROG mode 204) determines the actual temperature is lower than the reference temperature at this particular time and thus the air conditioner should be turned off, a high signal will appear on switch arm 206 of DAY/NIGHT switch 107 and the output of amplifier 210 changes to low. The B+ voltage being applied to resistor 242 is not opposed by the "high" voltage at the output of amplifier 210. Thus, the diode 240 is turned on and emits light which turns on the transistor 236. This in turn will cause the negative half cycles of $V_{AC}$ on switch arm 230 to be transmitted to ground through diode 238 and transistor 236 thereby terminating the transmission of negative half cycles to energy controller 12 via lead 14 such that the air conditioner will be turned off.

From the above, it will be noted that positive half cycles of $V_{AC}$ on lead 14 to energy controller 12 signal energy controller 12 to turn the furnace on and negative half cycles of $V_{AC}$ on lead 14 to energy controller 12 will signal energy controller 12 to turn the air conditioner on.

In a similar manner and as described below, positive half cycles of $V_{AC}$ transmitted to energy controller 12 via lead 16 will signal the energy controller 12 to turn the auxiliary unit 56 (shown in FIG. 1) on and negative half cycles of $V_{AC}$ transmitted to energy controller 12 via lead 16 will signal the energy controller 12 to turn the power shedder 56 (also shown in FIG. 1) on.

The auxiliary switch 103 includes an "ON" terminal 244, an "OFF" terminal 246 and a "PROG" terminal 248 and further includes a switch arm 250 connected to the lead 16 and to the $V_{AC}$ voltage through resistor 252. With switch arm 250 connected to OFF terminal 246, the positive half cycles of $V_{AC}$ are transmitted to ground through diode 254. Thus, no positive half cycles are transmitted via lead 16 to energy controller 12 and the auxiliary unit 54 is turned off in a manner which will be described.

The ON terminal 244 is not connected to anything; thus, when the switch arm 250 is connected to the ON terminal 244, the positive half cycles will be transmitted to energy controller 12 via lead 16 to turn auxiliary unit 54 on. (The negative half cycles are directed to the power shedder circuitry as will be described). When the switch arm 250 is connected to the PROG terminal 248, the positive half cycles are transmitted to ground through a diode 256 and a transistor 258 only when transistor 258 is conducting. The base of transistor 258 is connected to ground through bias resistor 260 and to AUX lead 138 of the microprocessor 22 shown in FIG. 3 through bias resistor 262. When microprocessor 22 provides a signal on AUX lead 138, the transistor 258 is turned ON and the positive half cycles of $V_{AC}$ are transmitted to ground via diode 256 and transistor 258. In summary, the positive half cycles of $V_{AC}$ will be transmitted to energy controller 12 via lead 16 when AUX switch 103 is set to PROG mode only when no signal appears on AUX lead 138 from microprocessor 22.

The SHED switch 105 includes an "ON" terminal 264, an "OFF" terminal 266 and a "PROG" terminal 268 and further includes a switch arm 270 connected to the lead 16 and to the $V_{AC}$ voltage through resistor 252. With switch arm 270 connected to OFF terminal 266, the negative half cycles of $V_{AC}$ on switch arm 270 are directed to ground through diode 272. Thus, no negative half cycles are transmitted via lead 16 to energy controller 12 when SHED switch 105 is switched to OFF position and the power shedder 56 will be deactivated as will be described below. The On terminal 264 is not connected to anything; therefore, when the switch arm 270 is moved to the ON terminal 264, the negative half cycles will be transmitted to energy controller 12 via lead 16 to activate the power shedder 56. When the switch arm 270 is moved to the PROG terminal 268, the negative half cycles of $V_{AC}$ are directed to ground through a diode 274 and an opto-isolator transistor 276, having a bias resistor 278 connected between the base and the emitter, only when the transistor 276 is conducting. If the transistor 276 is not conducting negative half cycles of $V_{AC}$ are directed via lead 16 to energy controller 12. A light emitting diode 280 is optically connected to opto-isolator transistor 276 so that when diode 280 emits light the transistor 276 becomes conducting. The diode 280 has its positive side connected to the B+ voltage through bias resistor 282 and its negative side to the collector of transistor 284. The emitter of transistor 284 is connected to ground. The base of transistor 284 is connected to ground through resistor 286 and to SHED lead 142 through bias resistor 288. The SHED lead 142 is connected to microprocessor 22 as shown in FIG. 2. With this arrangement, transistor 284 is conducting when a signal appears on SHED lead 142 whereupon diode 280 emits light, because the B+ voltage is then connected through resistor 282, diode 280 and transistor 284 to ground. When diode 280 emits light, transistor 276 is turned on and the negative half cycles of $V_{AC}$ are directed to ground through diode 274 and transistor 276. In summary, negative half cycles of $V_{AC}$ will be transmitted on lead 16 with SHED switch 105 set to PROG mode only when no signal appears on SHED lead 142 from microprocessor 22.

Figure 6:
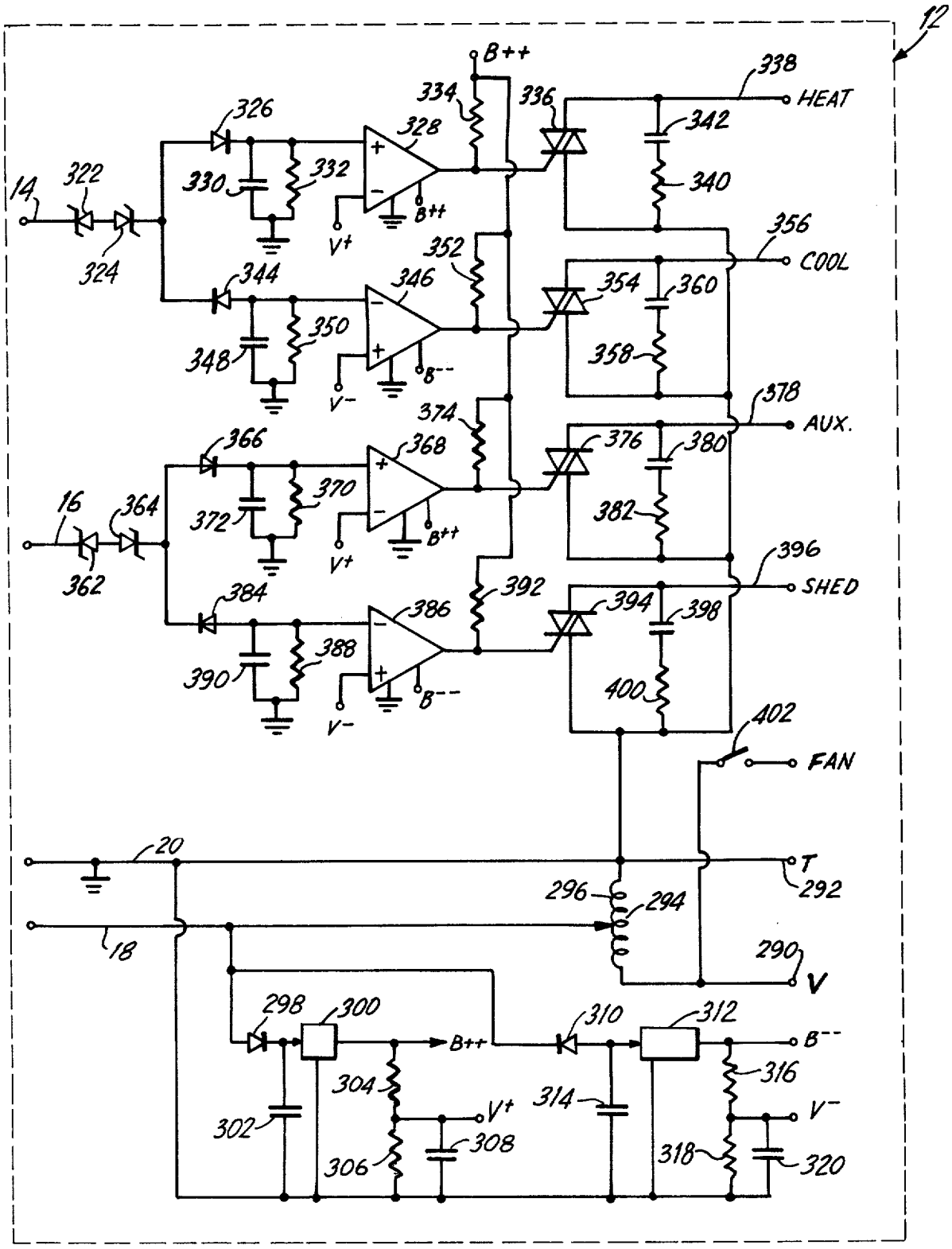
FIG. 6 is a schematic diagram of the energy controller connected to the programmable thermostat.

Referring now to FIG. 6, this Fig. is a schematic diagram of the electrical components of the energy controller 12. A voltage supply for the energy controller 12 is shown in the lower portion of this Fig. The voltage supply includes a terminal 290 connected to the voltage transformer 46 shown in FIG. 1 which conventionally forms a part of the furnace power supply. In a preferred embodiment, the terminal 290 is connected to a 24 volt alternating current terminal of the voltage transformer 46. A terminal 292 is connected to the reference voltage or ground terminal of voltage transformer 46. A transformer coil 294 is provided between terminal 290 and ground. A tap 296 is used to obtain the alternating current voltage $V_{AC}$ directed to the comparator and multiplexer 34 via lead 18.

The voltage $V_{AC}$ obtained from tap 296 is also directed to diode 298 and the positive half cycles of $V_{AC}$ are transmitted by this diode to a voltage regulator 300. The input terminal of voltage regulator 300 is connected to ground through filtering capacitor 302 and the voltage regulator 300 itself is connected to ground. The output of voltage regulator 300 provides an output voltage B++ at its output terminal. The voltage B++ is applied across voltage dividing resistors 304 and 306. Filtering capacitor 308 is connected to ground in parallel with resistor 306. The voltage at the junction between resistors 304 and 306 is the voltage V+.

The voltage $V_{AC}$ obtained from tap 296 is also directed to diode 310 and the negative half cycles of $V_{AC}$ are transmitted by this diode to voltage regulator 312. The input terminal of voltage regulator 312 is connected to ground through integrating capacitor 314 and the voltage regulator 312 itself is connected to ground. A voltage B−− appears at the output terminal of voltage regulator 312. This voltage is applied across voltage dividing resistors 316 and 318 to ground. An integrating capacitor 320 is connected to ground in parallel with resistor 318. The voltage at the junction between resistors 316 and 318 is the voltage V−.

The leads 14, 16, 18 and 20 connect the energy controller 12 to the comparator and multiplexer 34 as shown in FIG. 1. Lead 18 carries the voltage $V_{AC}$ and lead 20 is the reference voltage or ground lead. Positive and negative half cycles of $V_{AC}$ are transmitted from the comparator and multiplexer circuit 34 to energy controller 12 to control the furnace 44 and air conditioner 50 respectively. The positive and negative half cycles of $V_{AC}$ transmitted over lead 16 control the auxiliary unit 54 and the power shedder 56 respectively.

The signal on lead 14 is directed through a zener diode pair 322, 324 which are threshhold diodes and prevent the transmission of noise to the energy controller 12. The positive half cycles of the signal on lead 14 are transmitted by diode 326 to the positive terminal of comparator amplifier 328, energized by B++ voltage. The positive terminal of amplifier 328 is also connected to ground through an integrating network comprising a capacitor 330 and resistor 332 connected in parallel. This integrating network smooths out the signal transmitted by diode 326. The negative terminal of comparator amplifier 328 is connected to the V+ voltage provided by the energy controller power supply described above. The output terminal of amplifier 328 is connected to the B++ voltage through bias resistor 334 and to a traic 336. One terminal of the triac 336 is connected to ground and an output terminal of the triac 336 is connected to furnace relay 40 via lead 338 as shown in FIG. 1. The output terminal of triac 336 is also connected to ground through a noise suppressing circuit comprising a resistor 340 and a capacitor 342 connected in series. It will be noted that when positive half cycles of $V_{AC}$ appear on lead 14 from the comparator and multiplexer 34, the comparator amplifier 328 will provide a high signal output, V+ being selected to be less than the signal transmitted by diode 326, thereby activating triac 336 to provide a signal on lead 338 to close furnace relay 40 to turn the furnace 44 on. When no positive half cycles of $V_{AC}$ appear on lead 14, the relay 40 will be opened and the furnace 44 will be turned off.

The negative half cycles of $V_{AC}$ on lead 14 are transmitted by diode 344 to a negative terminal of comparator amplifier 346 energized by B−− voltage. The negative terminal of amplifier 346 is connected to ground through an integrating network comprising a capacitor 348 and resistor 350 connected in parallel. The positive terminal of amplifier 346 is connected to the voltage V− obtained from the energy controller voltage supply described above. The output terminal of amplifier 346 is connected to the B++ voltage through bias resistor 352 and to triac 354. The triac 354 is connected to ground and its output terminal is connected to lead 356 which is connected to air conditioning relay 48 as shown in FIG. 1. The lead 356 is connected to ground through the noise suppressing circuit having a resistor 358 and capacitor 360 connected in series.

Thus, when negative half cycles of $V_{AC}$ appear on lead 14 from the comparator and multiplexer 34, the comparator amplifier 346 will provide a high signal output, V− being selected to be more positive than the signal being transmitted by diode 344, thereby activating triac 354 to provide a signal on lead 356 to close air conditioning relay 48. This will cause the air conditioner to be turned on. When no negative half cycles appear on lead 14, the air conditioner will be turned off.

In a similar manner, positive and negative half cycles of $V_{AC}$ on lead 16 from the comparator and multiplexer 34 will activate the auxiliary unit 54 and power shedder 56 respectively. The components of this part of the energy controller 12 will be identified below but not described in detail.

The signal on lead 16 is transmitted through noise suppressing diodes 362, 364. The positive half cycles of $V_{AC}$ are directed through diode 366 to positive terminal of comparator amplifier 368 energized by B++ voltage. An integrating circuit comprising a resistor 370 and capacitor 372 connected in parallel, connects the positive input terminal of amplifier 368 to ground. The negative terminal of amplifier 368 is connected to the V+ voltage. The output terminal of amplifier 368 is connected to B++ voltage through resistor 374 and also to triac 376. Output of triac 376 is directed to lead 378 connected to auxiliary relay 52 shown in FIG. 1 and also to ground through noise suppressing circuit comprising capacitor 380 and resistor 382 connected in series. Positive half cycles on lead 16 cause amplifier 368 to have a high output which actuates triac 376 to close relay 52 to activate the auxiliary unit. When no positive half cycles appear on lead 16, the relay 52 opens and auxiliary unit 54 is turned off.

The negative half cycles of $V_{AC}$ on lead 16 are transmitted through diode 384 to negative terminal of comparator amplifier 386. This terminal is also connected to ground through resistor 388 and capacitor 390 connected in parallel. The positive terminal of amplifier 386 is connected to V− and the amplifier 386 is energized with B−− voltage. The output of amplifier 386 is connected to B++ voltage through resistor 392 and to triac 394. The triac 394 is connected to ground and its output terminal is connected to lead 396 which is connected to the power shedder 56 as shown in FIG. 1. The output of triac 394 is also connected to ground through a serially connected capacitor 398 and resistor 400.

Negative half cycles of $V_{AC}$ on lead 16 cause a signal to appear on lead 396 in a manner discussed previously causing the power shedder 56 to be activated. If no negative half cycles appear on lead 16, no signal appears on lead 396 and the power shedder 56 is deactivated. A fan switch 402 is provided to enable a user to manually turn on a fan as desired.

The microprocessor 22 as shown in FIG. 3 and described in detail in the Texas Instruments publication described above may be programmed to provide a signal on any or all of the AUX lead 138, the SET BACK lead 140 and the SHED lead 142 connected to the microprocessor 22 at selected times. The manner in which the microprocessor 22 is programmed to accomplish this is not described herein as the details are described in the above-identified publication incorporated herein by reference. Thus, the day temperature or the night temperature may be maintained at selected times as programmed by the user; the auxiliary unit 54 may be activated or deactivated at selected times and the power shedder 56 may be activated or deactivated at selected times.

If manual operation is desired, a user may turn on or off the auxiliary unit and the power shedder unit with operation switches 103 and 105 respectively. The temperature may be manually set to the DAY temperature setting or the NIGHT temperature setting with switch 107. If automatic operation is desired any or all of the switches 103, 105 and 107 may be set to the program mode of operation such that the respective units are controlled by microprocessor 22 under program control. The system is very versatile and enables a user to manage energy usage of an entire energy using system and control temperature all with a programmable thermostat located for easy access by a user. By separating the programmable thermostat and the energy controller and using multiplexed communication signals between these units, the present invention may be used to replace conventional thermostats without the necessity of rewiring the living area and at the same time control multiple energy using units. The energy controller is located where wiring may be easily done and the units to be controlled can be easily connected to the energy controller.

The particular energy using units connected to the energy controller as described with respect to the preferred embodiment is not critical to the practice of this invention nor is the number of units connected to the energy controller. Furthermore, the number of wires connecting the energy controller to the programmable thermostat is not critical as multiplexing techniques other than that described with respect to the preferred embodiment could also be used.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

We claim:

1. A system for controlling temperature in a user programmed manner comprising:

a programmable thermostat having a thermostat for measuring temperature at its location and a microprocessor capable of being programmed by a user to set a programmed temperature for each of selected periods of time;

an energy controller located remotely from the programmable thermostat for selectively activating energy using units connected to the energy controller in response to control signals received from the programmable thermostat;

a low voltage cable means for continuously supplying operating power to the programmable thermostat and for providing a communication channel for directing control signals from the programmable thermostat operating under program control to the energy controller to activate a selected energy using unit, including a selected energy using unit for maintaining the programmed temperature at the programmable thermostat location for each of the selected periods of time; and wherein the programmable thermostat further includes multiplexing means for directing a multiplexed signal of multiple control signals on a communication channel whereby each of the multiple energy using units are controlled by a corresponding control signal received by the energy controller from the programmable thermostat.

2. An energy management system for managing energy in a user programmed manner comprising:

a user programmable thermostat having a thermostat for measuring temperature at the location of the programmable thermostat, a microprocessor for controlling the system under a user provided program and data input apparatus for entering program information into the microprocessor;

an energy controller located remotely from the programmable thermostat for selectively activating an energy shedding unit and energy using units connected to the energy controller in response to control signals received from the programmable thermostat; and communication channel means for directing control signals from the programmable thermostat operating under program control to the energy controller to activate a selected energy using unit to maintain the programmed temperature at the programmable thermostat location, to activate other selected energy using units and to activate the energy shedding unit;

the microprocessor adapted to be programmed to provide control signals for activating the selected energy using unit for selected periods of time and to provide control signals for activating the energy shedding unit for selected periods of time.

3. The energy management system according to claim 2 further including electrical power supply means connected to the energy controller for supplying electrical power to the energy controller and wherein the programmable thermostat is connected to the energy controller with a reference voltage lead and a power supply lead for directing power from the energy controller to the programmable thermostat.

4. The energy management system according to claim 2 wherein the programmable thermostat further includes multiplexing means for directing a multiplexed signal of multiple control signals on a communication channel whereby each of multiple energy using units are controlled by corresponding control signals received by the energy controller from the programmable thermostat over the communication channel carrying the multiplexed signal.

5. The energy management system according to claim 4 further including an electrical power supply means connected to the energy controller for supplying alternating current electrical power to the energy controller and wherein the programmable thermostat is connected to the energy controller with a reference voltage lead and a power supply lead for directing alternating current electrical power to the programmable thermostat.

6. The energy management system according to claim 5 wherein the multiplexing means directs positive half cycles of the alternating current electrical power supplied to the programmable thermostat on a first communication channel to signal the energy controller to activate a first energy using unit and wherein the multiplexing means further directs negative half cycles of the alternating current electrical power supplied to the programmable thermostat on the first communication channel to signal the energy controller to activate a second energy using unit.

7. The energy management system according to claim 6 wherein the multiplexing means directs positive half cycles of the alternative current electrical power supplied to the programmable thermostat on a second communication channel to signal the energy controller to activate the energy shedding unit and wherein the multiplexing means further directs negative half cycles of the alternating current electrical power supplied to the programmable thermostat on the second communication channel to signal the energy controller to activate another selected energy using unit.

* * * * *